US009180947B2

(12) United States Patent
Winnington-Ingram

(10) Patent No.: US 9,180,947 B2
(45) Date of Patent: Nov. 10, 2015

(54) SLIDER SHOE FITTING

(75) Inventor: Christopher Winnington-Ingram, London (GB)

(73) Assignee: RIVER SAILING SINGHIES LIMITED, London (GB)

( * ) Notice: Subject to any disclaimer, the term of this patent is extended or adjusted under 35 U.S.C. 154(b) by 530 days.

(21) Appl. No.: 13/450,386

(22) Filed: Apr. 18, 2012

(65) Prior Publication Data

US 2012/0266798 A1 Oct. 25, 2012

(30) Foreign Application Priority Data

Apr. 21, 2011 (GB) ..... 1106959.8

(51) Int. Cl.

| | |
|---|---|
| ***B63B 15/00*** | (2006.01) |
| ***B63H 9/10*** | (2006.01) |
| ***B21D 28/10*** | (2006.01) |
| ***B21D 53/40*** | (2006.01) |
| *B63H 9/08* | (2006.01) |

(52) U.S. Cl.

CPC *B63H 9/10* (2013.01); *B21D 28/10* (2013.01); *B21D 53/40* (2013.01); *B63H 2009/086* (2013.01)

(58) Field of Classification Search

CPC ..... B63B 12/006; B21D 28/10; B21D 53/40; B63H 9/08; B63H 9/10; B63H 2009/08; B63H 2009/086; B63H 2009/10

USPC ..... 114/89–99, 111–115

See application file for complete search history.

(56) References Cited

U.S. PATENT DOCUMENTS

| | | | | |
|---|---|---|---|---|
| 2,084,325 A | | 6/1937 | Duffy | |
| 4,144,830 A | | 3/1979 | McPherren | |
| 4,406,240 A | * | 9/1983 | Andersen | 114/99 |
| 7,152,543 B2 | * | 12/2006 | Raimondo | 114/102.1 |
| 2004/0069196 A1 | | 4/2004 | Falb | |

FOREIGN PATENT DOCUMENTS

| | | | | |
|---|---|---|---|---|
| EP | 1493658 | | 1/2005 | |
| FR | 1473135 A | | 3/1967 | |
| FR | 2900633 | | 11/2007 | |
| JP | 57007620 | | 1/1982 | |
| RU | 2167805 C1 | * | 5/2001 | B66C 23/82 |

OTHER PUBLICATIONS

Photograph #1 of "Gnav Shoe". Made by the applicant. This is a carbon fiber shoe connected to an existing plastic Selden slider fitting. First used in public by the inventor at some time in 2007 or 2008, and has been used in UK waters around Exmouth and the River Exe. Photographs #2 and #3 of two-piece fitting (strut and shoe) used by 29er dinghies. Shoe is a cast aluminum piece with some felt stuck on the bottom. Applicant does not know where or when this fitting was first publicly used. Applicant became aware of the fitting from the internet in or about Jul. 2012.

New Zealand Intellectual Property Office Examination Report dated Apr. 27, 2012 for corresponding application No. 599514, with Selden Mast Note "GNAV Arrangement, Aluminium Dinghy Masts" 595-485-E dated Mar. 5, 2005.

* cited by examiner

*Primary Examiner* — Daniel V Venne

(74) *Attorney, Agent, or Firm* — Heslin Rothenberg Farley & Mesiti P.C.; Victor A. Cardona, Esq.

(57) ABSTRACT

A slider shoe fitting for a gnav assembly (8) for exerting a downward force on a boom (5). The slider shoe fitting comprises a boom slider (10) for sliding along an upper portion of a surface of a boom, and a strut portion for forming at least part of a strut of the gnav assembly (8). The boom slider (10) comprises a body portion (11) and a plurality of upstanding portions (15). The body portion (11) and upstanding portions (15) are of a single piece of material. The strut portion is pivotally mounted to the plurality of upstanding portions (15).

18 Claims, 6 Drawing Sheets

SLIDER SHOE FITTING

PRIORITY CLAIM

This application claims priority to Great Britain Patent Application Number 1106959.8, entitled Slider Shoe Fitting, filed on Apr. 21, 2011.

This invention relates to rigging for vehicles with sails such as dinghies, and in particular to gnav assemblies and slider shoe fittings of gnav assemblies for use as part of such rigging. A gnav assembly is a mechanism for exerting a downward force on a boom of a vehicle and comprises means movable along the boom and a strut pivotally connectable to the movable means and a mast. Such mechanisms may be used in place of yang systems or kicking straps, which comprise ropes or mechanisms located below the boom for pulling the boom downwards.

According to one aspect of the present invention there is provided a slider shoe fitting for a gnav assembly for exerting a downward force on a boom;

the slider shoe fitting comprising a boom slider for sliding along an upper portion of a surface of a boom, and a strut portion for forming at least part of a strut of the gnav assembly;

wherein the boom slider comprises a body portion and a plurality of upstanding portions, the body portion and upstanding portions being of a single piece of material;

and wherein the strut portion is pivotally mounted to the plurality of upstanding portions.

The boom slider may be made from sheet metal. Preferably the boom slider is made from stainless steel.

The upstanding portions may be created by providing cuts in the sheet material and bending material portions defined by the cuts about a bending line. The sheet material may comprise cut-outs. The body portion may define a longitudinal axis along its length, and the bending line may be aligned with the longitudinal axis. The body portion may comprise a central portion along the longitudinal axis, and the bending line may be located away from the central portion, towards an edge of the body portion.

The bending line may be located on the body portion such that it is lower than an uppermost portion of the underside of the boom slider.

The cuts provided in the sheet material may be provided by water jet cutting. Alternatively, the cuts provided in the sheet material may be provided by laser cutting.

There may be an enlarged cut adjacent the bending line of the upstanding portions for stress relief. The cuts provided in the sheet material may be arranged such that an edge portion of an upstanding portion adjacent the bending line is substantially perpendicular to the bending line. This may facilitate bending of the upstanding portion.

Preferably, there are two upstanding portions. The upstanding portions may be located either side of the central portion. The upstanding portions may be arranged opposite to one another. The upstanding portions may be located equidistant from the central portion.

The upstanding portions may be spaced apart from each other by at least one third of the width of the boom slider. Preferably, the upstanding portions are spaced apart from each other by at least half of the width of the boom slider. Preferably, the upstanding portions are spaced apart from each other by at least two thirds of the width of the boom slider.

Preferably, the upstanding portions are located centrally along the length of the boom slider.

The upstanding portions may comprise creases across the bending line for strengthening the upstanding portions. The upstanding portions may be generally triangular in shape, with an apex of the triangle oriented away from the body portion of the boom slider. Each upstanding portion may comprise an aperture for mounting the strut to the boom slider. The apertures may be located towards the apex of the upstanding portions.

The underside of the body portion may be smoothly curved. The underside of the body portion may be free from engagement portions to hold it on a boom. The underside of the body portion may have a part-circular cross-section. Alternatively, the underside of the body portion may have a part-oval cross-section.

The underside of the body portion may have a shape corresponding to the upper portion of a surface of a boom. In this context, this can include the underside of the body portion having a radius of curvature equal to, or slightly larger than, a radius of curvature of the upper portion of a surface of a boom. In other words, the boom slider fits onto a boom, but there may be some tolerance in the fit.

The underside of the body portion may be provided with at least one strip of PTFE material for reducing friction between the boom slider and the boom, wherein one side of the strip of PTFE material may be etched, facilitating the adherence of the strip of PTFE material to the underside of the body portion. The strip of PTFE material may be aligned with the longitudinal axis of the body portion.

The strip of PTFE material may be provided away from an uppermost portion of the underside of the body portion. Thus there may be a clearance between the uppermost portion of the underside of the body portion and the upper portion of a surface of a boom on which the slider is fitted.

The boom slider may comprise rounded corners.

The body portion may comprise an integral mounting portion for a pulley. The integral mounting portion may be located towards an end of the body portion, along its longitudinal axis. The mounting portion may comprise a portion of the body portion bent relative to the remainder of the body portion. The mounting portion may be bent away from the underside of the body portion. The mounting portion may comprise at least one aperture for mounting a pulley.

The strut portion may be a spigot to which a strut member is mountable to form the strut. In such a case said strut member will typically be a hollow tubular member such as an aluminium shaft. The strut portion may comprise the complete strut.

The spigot may comprise a spigot body portion defining a spigot longitudinal axis and a plurality of spigot mounting portions for mounting the spigot to the boom slider, which spigot mounting portions are laterally spaced from the spigot longitudinal axis.

The spigot mounting portions may be mounted to the upstanding portions by a bolt. Washers may be provided between the spigot mounting portions and the upstanding portions to absorb shock. The shock absorbing washers may be made of nylon.

The spigot may comprise at least one cutaway portion adjacent the spigot mounting portions which enables a greater relative pivoting between the spigot and the boom slider than would otherwise be possible.

The spigot may comprise at least one recess portion located adjacent the spigot mounting portions which enables the spigot to be mounted to the boom slider such that the spigot mounting portions are closer to the boom slider body portion than would otherwise be possible. The spigot mounting portions may protrude into the cut-outs of the boom slider.

According to another aspect of the present invention there is provided a gnav assembly having a strut for exerting a downward force on a boom, the gnav assembly comprising a slider shoe fitting, the slider shoe fitting comprising a boom slider for sliding along an upper portion of a surface of a boom, and a strut portion which forms at least part of the strut in the gnav assembly, wherein the boom slider comprises a body portion and a plurality of upstanding portions, the body portion and upstanding portions being of a single piece of material, and wherein the strut portion is pivotally mounted to the plurality of upstanding portions.

The gnav assembly typically comprises a mast end toggle for pivotal mounting of the gnav assembly to a mast.

The slider shoe fitting of said other aspect may comprise any one of, or any combination of, the additional features described above in relation to the slider shoe fitting mentioned as part of said one aspect defined above.

According to yet another aspect of the present invention there is provided rigging for a vehicle, the rigging comprising a mast, a boom and a gnav assembly having a strut for exerting a downward force on the boom, the gnav assembly comprising a slider shoe fitting, the slider shoe fitting comprising a boom slider for sliding along an upper portion of a surface of the boom, and a strut portion which forms at least part of the strut in the gnav assembly, wherein the boom slider comprises a body portion and a plurality of upstanding portions, the body portion and upstanding portions being of a single piece of material, and wherein the strut portion is pivotally mounted to the plurality of upstanding portions; wherein an underside of the body portion has a shape corresponding to an upper portion of the surface of the boom.

The gnav assembly typically comprises a mast end toggle for pivotal mounting of the gnav assembly to the mast.

The slider shoe fitting of said yet another aspect may comprise any one of, or any combination of, the additional features described above in relation to the slider shoe fitting mentioned as part of said one aspect defined above.

According to a further aspect of the present invention there is provided a method of making a boom slider comprising the steps of;

cutting a flat sheet of material;

bending at least two portions of the material away from the sheet material, towards the same side of the sheet, to form upstanding portions;

bending the sheet material so that it curves away from the upstanding portions so as to have a shape corresponding to an upper portion of a surface of a boom; and introducing creases at the join between the upstanding portions and the bent sheet material to strengthen the upstanding portions.

The method may comprise the step of bending the sheet material so that an underside curves smoothly.

The sheet material may be cut using a water jet. The sheet material may be cut using a laser.

Embodiments of the present invention will now be described by way of example only with reference to the accompanying drawings in which:

FIG. 1 schematically shows rigging for a sailing vehicle;

FIG. 2 is a perspective view of part of a gnav assembly—a slider shoe fitting—of the rigging shown in FIG. 1;

FIGS. 3*a* and 3*b* are perspective views of part of the gnav assembly shown in FIG. 2;

Figure 1:
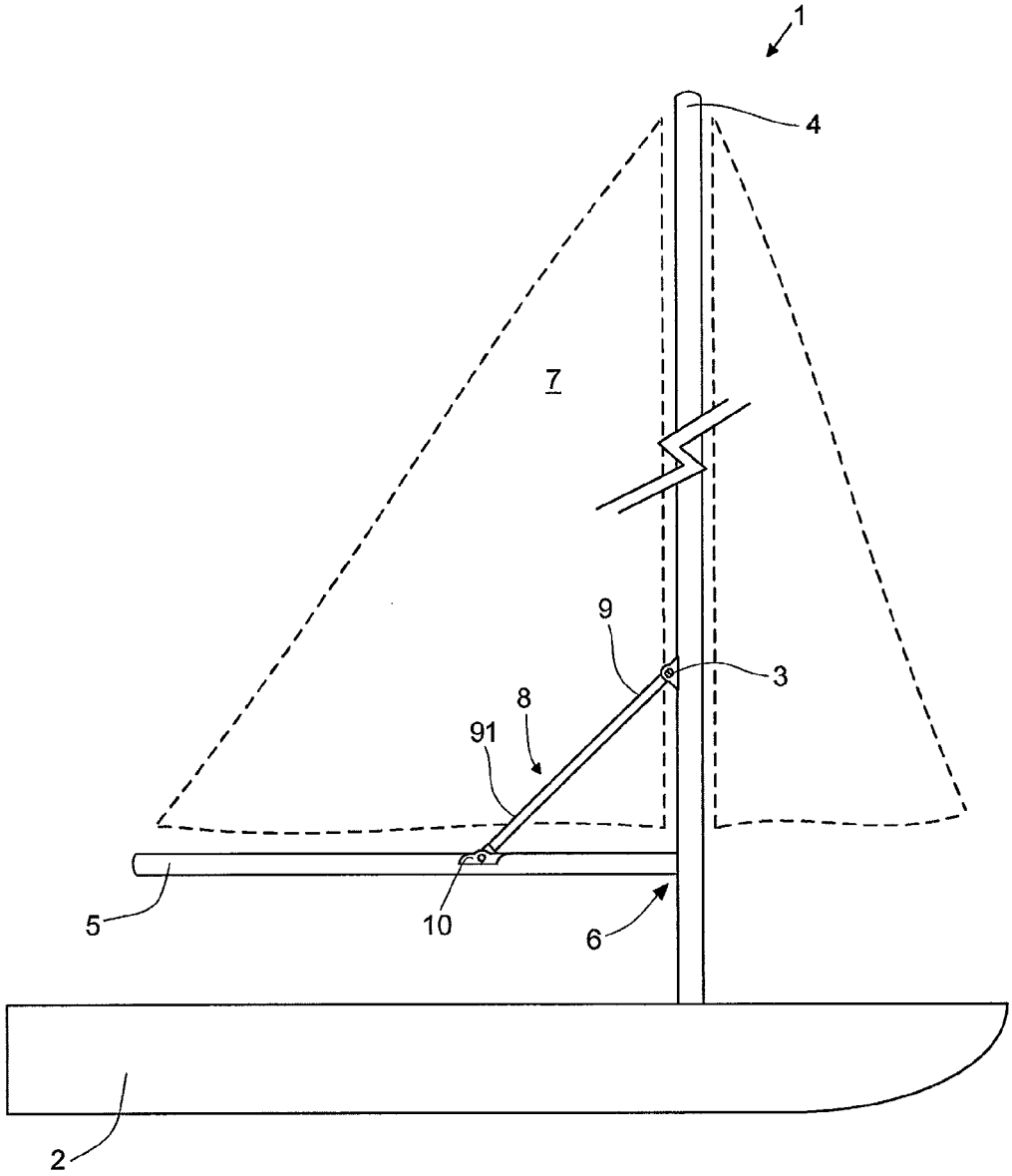

FIG. 1 shows a sailing vehicle 1 comprising a hull 2. Rigging is provided on the hull 2. The rigging comprises a mast 4 and a boom 5. The mast 4 is provided generally upstanding from the hull 2 and the boom 5 is pivotally connected to the mast 4 about a pivot joint 6. Sails 7 are supported by the mast 4.

A gnav assembly 8 is provided between the mast 4 and the boom 5 for exerting a downward force on the boom 5. This allows greater control of the sail 7. The gnav assembly comprises a strut 9 with a fixed length. The gnav assembly comprises a slider shoe fitting, the slider shoe fitting comprising a boom slider 10 for sliding along an upper portion of a surface of the boom 5 and a strut portion. In this embodiment, the strut portion comprises a spigot 21 (see FIG. 2). An aluminium tubular member is mounted to the spigot to form the strut 9.

A first end of the strut 9 is pivotally mounted to the mast 4 by a standard mast end toggle about a mounting point 3. A second end of the strut 9 is pivotally mounted to the boom slider 10 via the spigot 21. The boom slider 10 is arranged so that it can slide along an upper portion of the surface of the boom 5 towards and away from the mast 4, i.e. along at least part of the length of the boom 5.

Thus, as the boom slider 10 slides along the upper portion of the surface of the boom 5 towards the mast 4, the boom 5 will tend to move/be pushed downwards. In one embodiment, control of the boom slider 10 is effected by means of a pulley (not shown) mounted to the boom slider 10; a rope passing through the pulley allows the boom slider 10 to be drawn towards the mast 4.

In alternative embodiments, a pulley may be mounted to the strut portion. In yet other embodiments, the strut portion may comprise an aperture for receiving a rope, allowing the boom slider to be drawn towards the mast.

When the sailing boat 1, or the wind, changes directions, the boom 5 may pivot about the pivot joint 6 and move sideways relative to the hull 2. When the boom 5 reaches the end of its motion, it may experience a sharp decelerating force resulting in a sideways shock force to the boom slider 10 which may tend to cause the boom slider 10 to experience a torque about the boom 5. Various features of the present apparatus have been developed with this in mind, and will be described in more detail below.

More detail of the boom slider 10 is described below with reference to FIGS. 2 to 5. As will become apparent from the drawings and the following description, the boom slider 10 is made of a piece of sheet metal which has been cut and bent into shape. In one embodiment the boom slider is made from stainless steel, although other suitable materials may be used. The boom slider 10 has rounded corners. Since the boom slider 10 is located on the boom 5 in use, the provision of rounded corners serves to reduce the likelihood of injury should the boom slider 10 contact a person, and also reduces the likelihood of the boom slider 10 catching an edge whilst sliding along the boom 5.

Figure 2:
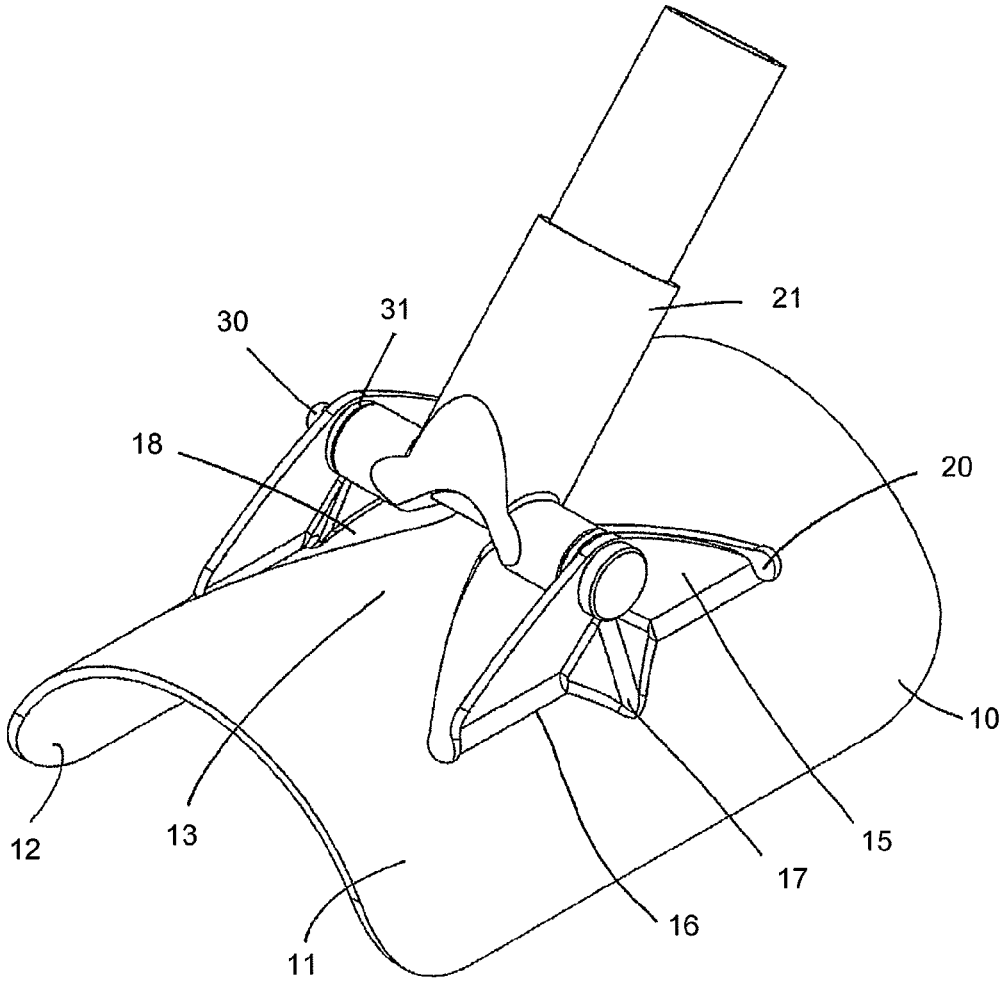

Referring to FIG. 2, the boom slider 10 comprises a cylindrically curved body portion 11. The concave side of the body portion 11 is its underside 12. The boom slider 10 further comprises a central portion 13. The boom slider 10 has a longitudinal axis 14 aligned along the length of the body portion 11 of the boom slider 10. The longitudinal axis 14 is aligned with the central portion 13 (see FIG. 4).

Figure 5:
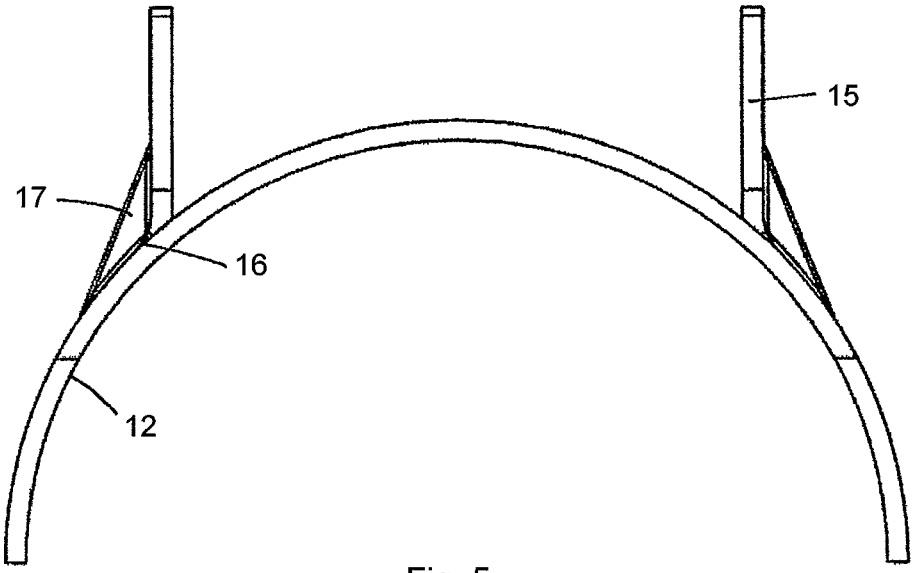
FIG. 5 is a side view of the part of the gnav assembly shown in FIGS. 3*a* and 3*b;*

As can best be seen from FIG. 5, the underside 12 of the boom slider 10 is smoothly curved. The underside 12 of the boom slider 10 does not comprise any engagement portions to hold it in place on a boom 5. The boom slider 10 is designed for use with a boom with no protruding or recessed engagement features on its curved surfaces.

Modern lightweight booms are typically made from carbon fibre and may have circular or oval cross-sections and generally no surface features. In this embodiment the boom slider 10 has a part circular cross-section so as to correspond to the upper portion of the surface of a boom 5 with a circular cross-section. In alternative embodiments, the boom slider 10 may have differing curvature, for example a part-oval cross-section so as to correspond to a boom with an oval cross-section. In some embodiments the boom slider 10 may have a radius of curvature slightly larger than that of the boom, such that limited lateral movement is possible. This may reduce the sideways stress or shock on the boom slider 10.

Figure 3B:
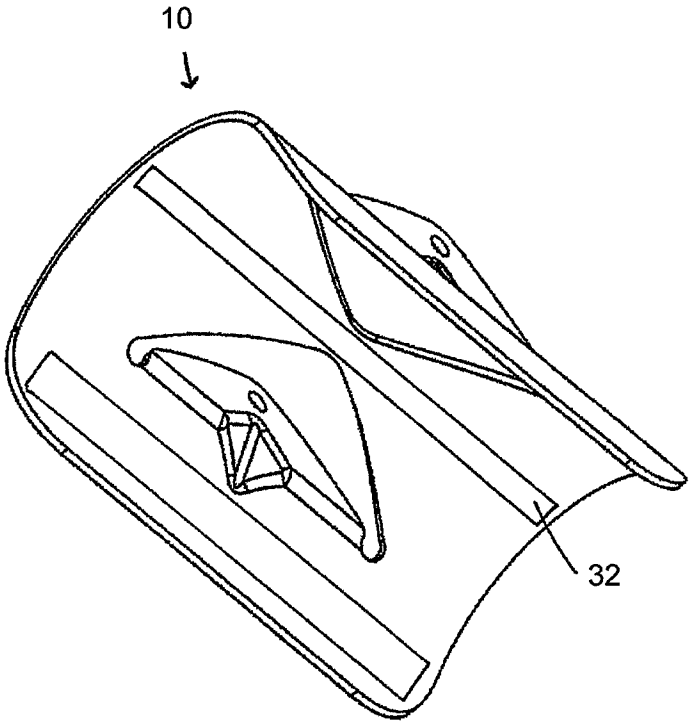

Strips of PTFE material 32 are provided on the underside 12 of the boom slider 10. The strips of PTFE material 32 extend longitudinally along the length of the boom slider 10, as can be seen in FIG. 3*b*. The provision of the strips of PTFE material 32 facilitate easy sliding of the boom slider 10 along the boom 5. Prior to adhering the strips of PTFE material 32 to the underside 12 of the boom slider 10, one side of the strips of PTFE material 32 is etched so as to provide an appropriate surface for adhering to the boom slider 10.

In other embodiments there may not be a strip of PTFE material at an uppermost portion of the underside of the body portion. Thus there may be a clearance between the uppermost portion of the underside of the body portion and the upper portion of a surface of a boom, thus helping to avoid grit under the boom slider 10 that is pushed to the top of the underside of the body portion affecting the sliding of the boom slider 10.

The boom slider 10 further comprises two upstanding portions 15. The upstanding portions 15 comprise generally triangular portions which are bent away from the body portion 11 along a bending line 16. The upstanding portions 15 are connected to the body portion 11 along the bending line 16.

The bending line 16 is aligned along the length of the boom slider 10 such that the bending line 16 is parallel to the longitudinal axis 14. A crease 17 is provided in the bending line 16. In this embodiment the crease 17 is provided at the midpoint of the bending line 16, and is perpendicular to the bending line 16. The provision of the crease 17 strengthens the upstanding portions 15 and reduces the likelihood of the upstanding portions 15 flexing about the bending line 16.

The upstanding portions 15 are bent away from the body portion 11 of the boom slider 10 such that two cut-outs 18 remain in the body portion 11. The cut-outs 18 are located at a midpoint along the length of the boom slider 10. One cut-out is located to each side of the central portion 13. The central portion 13 narrows due to the location of the two cut-outs 18, as can best be seen from FIG. 4.

Figure 3A:
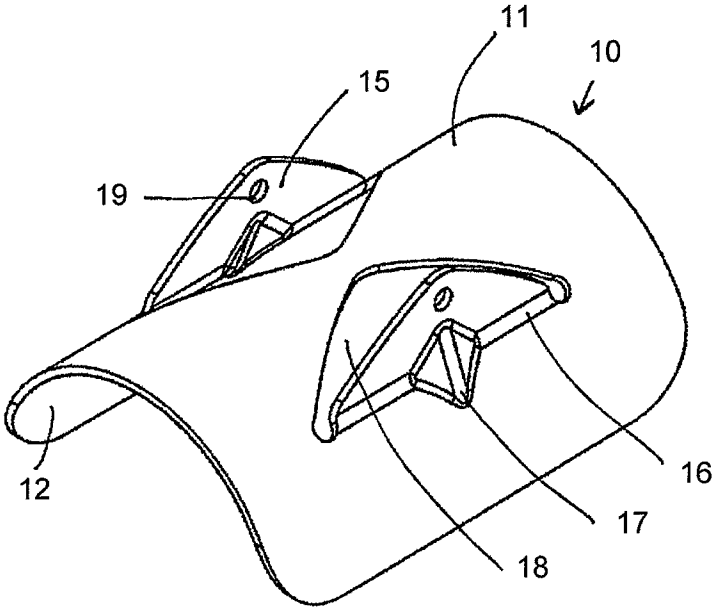
Figure 4:
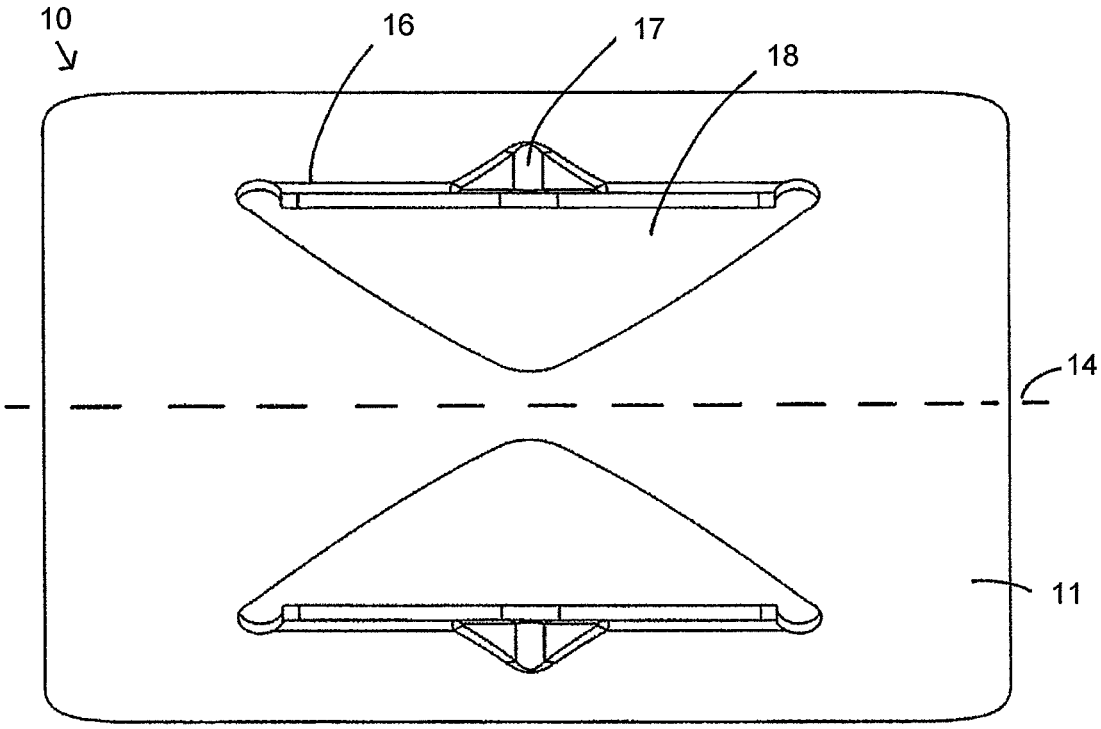
FIG. 4 is a top view of the part of the gnav assembly shown in FIGS. 3*a* and 3*b;*

The upstanding portions 15 comprise mounting means. Referring to FIG. 3*a*, the mounting means comprises an aperture 19 provided towards an apex of each triangular upstanding portion 15 that is away from the bending line 16.

There are two upstanding portions 15 which are provided at a midpoint along the length of the boom slider 10. Providing the upstanding portions 15 at this location on the boom slider 10 improves the stability of the gnav assembly 8 in use.

The bending lines 16, and hence the respective upstanding portions 15, are located either side of the longitudinal axis 14 of the boom slider 10. Providing the upstanding portions 15 spaced laterally from the longitudinal axis 14 in this way improves the stability of the gnav assembly in use. The upstanding portions 15 are provided opposite one another and are generally parallel such that the aperture 19 in one upstanding portion 15 is aligned with the aperture 19 in the other upstanding portion 15.

As can be seen from FIG. 5, the bending line 16 is provided at a portion of the body portion 11 of the boom slider 10 that is below the uppermost part of the underside 12 of the boom slider 10.

Locating the mounting means of the boom slider 10 closer to the boom 5 reduces the potential torque applied to the boom slider 10 in use. This therefore increases the stability of the gnav assembly 8.

As mentioned above, the boom slider 10 is formed by cutting sheet material and bending it into shape. Cuts are made in the sheet material to define edges for the upstanding portions 15. The cuts may be made by water jet cutting, laser cutting, or other appropriate cutting methods.

An enlarged cut 20 is made at either end of the cut made in the sheet material (see FIG. 2). The enlarged cut 20 provides a stress-relieving portion when the upstanding portions 15 are bent away from the sheet material. This results in material under a lower resulting strain, and hence improves the stability of the boom slider 10.

In this embodiment, the enlarged cut 20 is made such that an end portion of the cut is generally perpendicular to the bending line 16. This facilitates the bending of the upstanding portions 15 about the bending lines 16.

Figure 6:
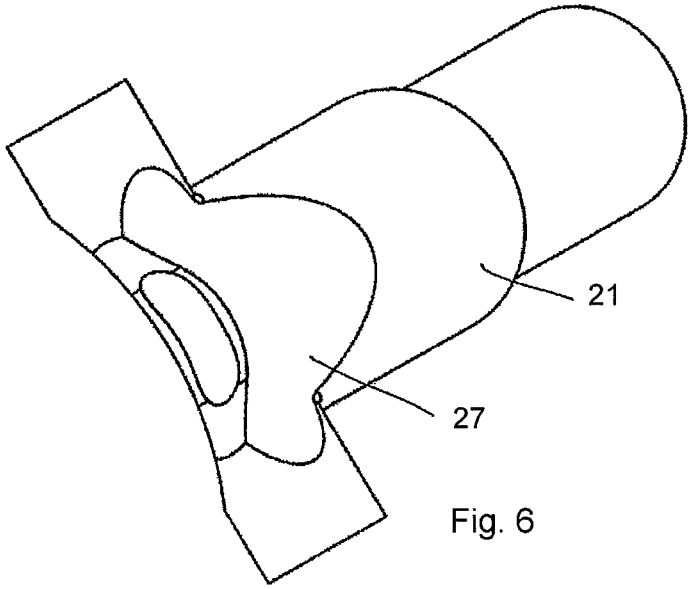
FIG. 6 is a perspective view of a different part of the gnav assembly shown in FIG. 2.
Figure 7A:
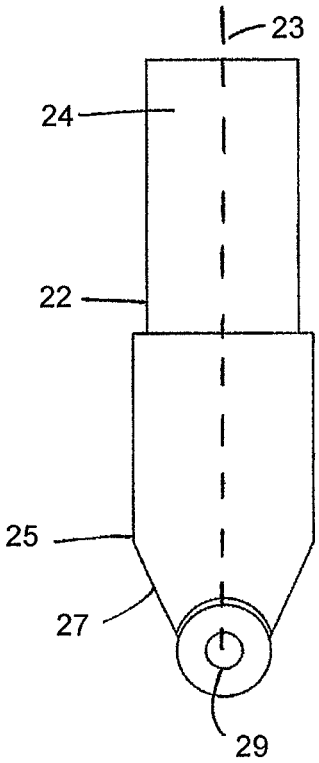
FIG. 7 is a side view of the different part of the gnav assembly shown in FIG. 6.

The spigot 21 will now be further described, with reference to FIGS. 6 and 7.

The spigot 21 comprises a spigot body 22. The spigot body 22 is generally cylindrical and defines a spigot longitudinal axis 23 along the length of the spigot body 22. A first end 24 of the spigot body 22 has an outer diameter adapted to fit within a hollow end of the strut member 91. The spigot 21 is riveted to the strut member 91. In other embodiments, alternative attachment means may be used. A second end 25 of the spigot 21 comprises spigot mounting portions 26.

Figure 7B:
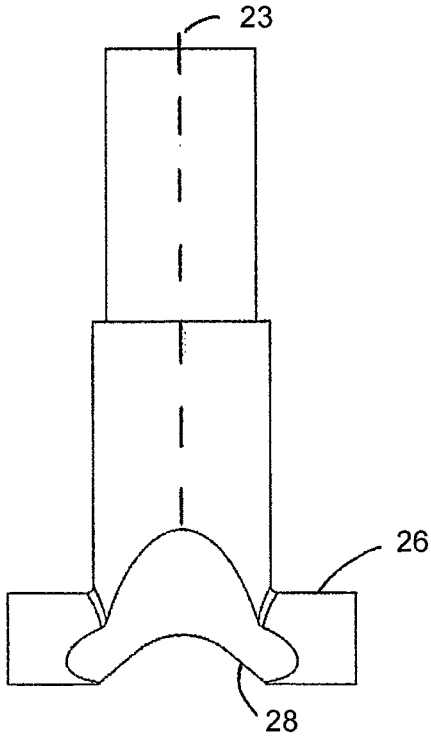

Referring to FIG. 7*b*, there are two spigot mounting portions 26. The spigot mounting portions are provided offset from the spigot longitudinal axis 23. The spigot mounting portions 26 are provided on opposite sides of the spigot 21.

The spigot mounting portions 26 comprise an aperture 29 for receiving a bolt 30. The bolt 30 passes through both of the spigot mounting portions 26, as can be seen from FIG. 2.

The bolt 30 mounts the spigot mounting portions 26 to the upstanding portions 15 of the boom slider 10.

When the spigot 21 is mounted to the boom slider 10, the bolt 30 passes through the aperture 19 in one of the upstanding portions 15, through the aperture 29 in the spigot mounting portions 26 and through the aperture 19 in the other upstanding portion 15.

Respective washers 31 are provided between the spigot mounting portion 26 and the respective upstanding portions 15 (see FIG. 2). Each washer 31 is made from nylon, and absorbs some of the shock on the boom slider 10 that occurs at the end of lateral travel of the boom 5. This reduces the shock transferred to the rest of the gnav assembly 8. This shock absorption assists in maintaining the stability of the gnav assembly 8.

In other embodiments, respective washers may be provided on the outside of the respective upstanding portions 15 in addition to or in alternative to being provided on the inside of the respective upstanding portions 15. This may reduce the shock transferred to the rest of the gnav assembly 8.

In this way the spigot 21 is pivotally mounted to the boom slider 10 and may pivot about the axis of the bolt 30. As the boom slider 10 slides along the boom 5 towards or away from the mast 4, the spigot 21 will pivot relative to the boom slider 10.

Respective cut-away portions 27 are provided towards the second end 25 of the spigot 21. As can be seen from FIG. 7*a* there are two cut-away portions 27, one provided each side of the second end 25 of the spigot 21, between the spigot mounting portions 26.

The cut-away portions 27 facilitate the pivoting of the spigot 21 relative to the boom slider 10. As the spigot 21 pivots in one direction relative to the boom slider 10, the second end 25 of the spigot 21 will get closer to the boom slider 10. When the spigot 21 contacts the boom slider 10, the spigot 21 will not pivot further in that direction. Providing cut-away portions 27 extends the range of pivotal motion of the spigot 21 relative to the boom slider 10. The cut-away portions 27 also enable the range of pivotal motion of the spigot 21 relative to the boom slider 10 to be maintained as the axis about which the spigot pivots, i.e. that of the bolt 30, is made to be closer to the body portion 11 of the boom slider 10.

Hence the provision of the cut-away portions 27 facilitates the increased stability of the boom slider 10 by allowing the apertures 19 to be provided closer to the body portion 11 whilst maintaining the range of pivotal motion of the spigot 21 relative to the boom slider 10.

The second end 25 of the spigot 21 further comprises a recess portion 28 (see FIG. 7*b*). The recess portion 28 is located between the two spigot mounting portions 26. The recess portion 28 comprises a curved portion. In alternative embodiments the recess portion 28 may be shaped differently.

The recess portion 28 is arranged such that the narrow portion of the central portion 13 is able to be received into the recess portion 28. The spigot mounting portions 26 will then protrude into the cut-outs 28. The provision of the recess portion 28 thus enables the apertures 19 on the upstanding portions 15 to be located closer to the body portion 11, which results in a more stable gnav assembly 8 as mentioned above.

Figure 8:
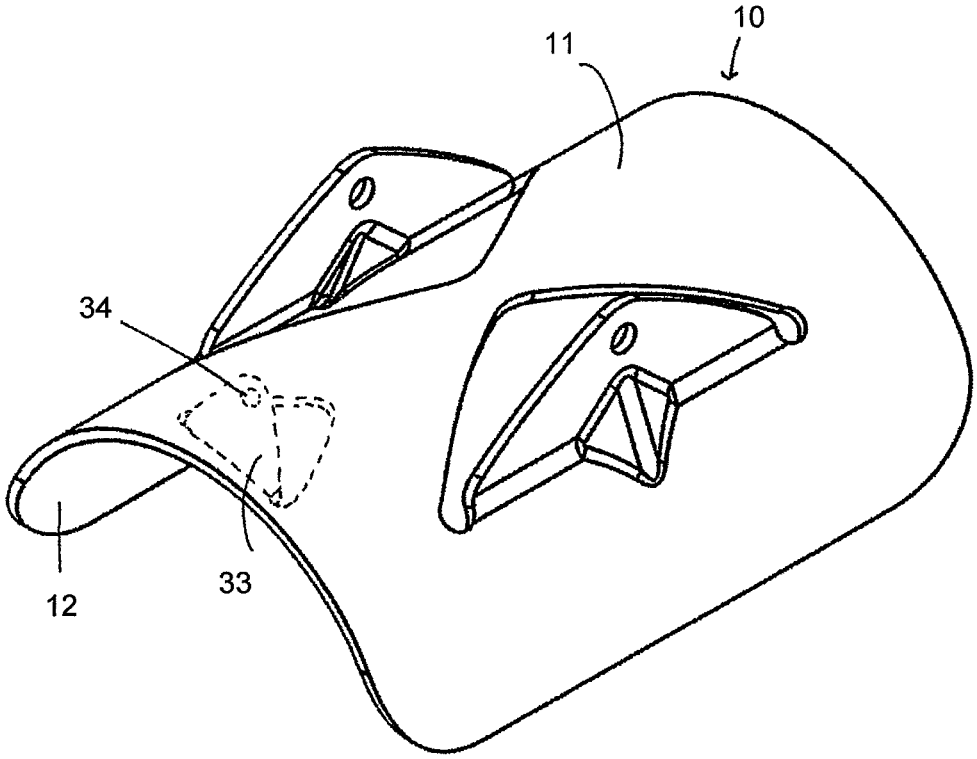
FIG. 8 is a perspective view of part of the gnav assembly shown in FIG. 2 showing a further development.

FIG. 8 shows a boom slider 10 of another embodiment. In this embodiment, the boom slider 10 comprises an integral mounting portion, but otherwise the gnav assembly of this embodiment will be the same as above. The integral mounting portion comprises a front upstanding portion 33. The front upstanding portion 33 is located on the body portion 11 of the boom slider 10, towards an end of the boom slider 10. In use, the front upstanding portion 33 is located at the end of the boom slider 10 which faces the mast 4.

The front upstanding portion 33 comprises an aperture 34 for mounting a pulley (not shown). A rope (not shown) passing through the pulley enables the boom slider 10 to be drawn towards the mast 4. Providing slack in the rope allows the boom slider 10 to move away from the mast 4. The front upstanding portion 33 is located on the longitudinal axis 14 of the boom slider 10. This enables the boom slider 10 to be drawn towards the mast 4 without introducing a twisting force.

In this embodiment, the front upstanding portion 33 comprises a triangular portion cut out of the body portion 11 of the boom slider 10. Cuts defining the front upstanding portion 33 may be provided by water jet cutting or by laser cutting.

The front upstanding portion 33 is bent about a bending line located towards the end of the boom slider 10. In alternative embodiments, the front upstanding portion 33 may be bent about a bending line located away from the end of the boom slider 10. In the embodiment shown in FIG. 8, the axis of the aperture 34 for mounting the pulley generally faces the mast 4. It is envisaged that, in other embodiments, the axis of the aperture 34 for mounting the pulley may be generally upright.

The invention claimed is:

1. A slider shoe fitting for a gnav assembly for exerting a downward force on a boom;

the slider shoe fitting comprising a boom slider for sliding along an upper portion of a surface of a boom, and a strut portion for forming at least part of a strut of the gnav assembly;

wherein the boom slider is made from sheet material and, comprises a body portion and a plurality of upstanding portions, the body portion and upstanding portions being of a single piece of material;

wherein the strut portion is pivotally mounted to the plurality of upstanding portions; and wherein the upstanding portions have been created by providing cuts in the sheet material, the cuts defining material portions, and by bending the material portions defined by the cuts about a bending line.

2. A slider shoe fitting according to claim 1 in which the sheet material comprises cut-outs.

3. A slider shoe fitting according to claim 1 in which the body portion defines a longitudinal axis along its length, and the bending line may be aligned with the longitudinal axis.

4. A slider shoe fitting according to claim 3 in which the bending line is located on the body portion such that it is lower than an uppermost portion of an underside of the boom slider.

5. A slider shoe fitting according to claim 3 in which the cuts provided in the sheet material are arranged such that an edge portion of an upstanding portion adjacent the bending line is substantially perpendicular to the bending line.

6. A slider shoe fitting according to claim 3 in which the upstanding portions comprise creases across the bending line for strengthening the upstanding portions.

7. A slider shoe fitting according to claim 1 in which the upstanding portions are located centrally along a length of the boom slider.

8. A slider shoe fitting according to claim 1 in which an underside of the body portion is free from engagement portions to hold it on a boom.

9. A slider shoe fitting according to claim 1 in which an underside of the body portion has a shape corresponding to the upper portion of a surface of a boom.

10. A slider shoe fitting according to claim 1 in which an underside of the body portion is provided with at least one strip of PTFE material for reducing friction between the boom slider and the boom, wherein one side of the strip of PTFE material may be etched, facilitating the adherence of the strip of PTFE material to the underside of the body portion.

11. A slider shoe fitting according to claim 10 in which the strip of PTFE material is provided away from an uppermost portion of the underside of the body portion.

12. A slider shoe fitting according to claim 1 in which the strut portion comprises a spigot to which a strut member is mountable to form the strut.

13. A slider shoe fitting according to claim 12 in which the spigot comprises a spigot body portion defining a spigot longitudinal axis and a plurality of spigot mounting portions for mounting the spigot to the boom slider, which spigot mounting portions are laterally spaced from the spigot longitudinal axis.

14. A slider shoe fitting according to claim 13 in which the spigot comprises at least one cutaway portion adjacent the spigot mounting portions which enables a greater relative pivoting between the spigot and the boom slider than would otherwise be possible.

15. A slider shoe fitting according to claim 13 in which the spigot comprises at least one recess portion located adjacent the spigot mounting portions which enables the spigot to be mounted to the boom slider such that the spigot mounting portions are closer to the boom slider body portion than would otherwise be possible.

16. A slider shoe fitting according to claim 13 in which the sheet material comprises cut-outs, and the spigot mounting portions protrude into the cut-outs of the boom slider.

17. A gnav assembly having a strut for exerting a downward force on a boom, the gnav assembly comprising a slider shoe fitting, the slider shoe fitting comprising a boom slider for sliding along an upper portion of a surface of a boom, and a strut portion which forms at least part of the strut in the gnav assembly, wherein the boom slider is made from sheet material and comprises a body portion and a plurality of upstanding portions, the body portion and upstanding portions being of a single piece of material, wherein the strut portion is pivotally mounted to the plurality of upstanding portions; wherein the upstanding portions have been created by providing cuts in the sheet material, the cuts defining material portions, and by bending the material portions defined by the cuts about a bending line.

18. Rigging for a vehicle, the rigging comprising a mast, a boom and a gnav assembly having a strut for exerting a downward force on the boom, the gnav assembly comprising a slider shoe fitting, the slider shoe fitting comprising a boom slider for sliding along an upper portion of a surface of the boom, and a strut portion which forms at least part of the strut in the gnav assembly, wherein the boom slider is made from sheet material and comprises a body portion and a plurality of upstanding portions, the body portion and upstanding portions being of a single piece of material, wherein the strut portion is pivotally mounted to the plurality of upstanding portions; wherein the upstanding portions have been created by providing cuts in the sheet material, the cuts defining material portions, and by bending the material portions defined by the cuts about a bending line; and wherein an underside of the body portion has a shape corresponding to an upper portion of the surface of the boom.

* * * * *

UNITED STATES PATENT AND TRADEMARK OFFICE

CERTIFICATE OF CORRECTION

PATENT NO. : 9,180,947 B2
APPLICATION NO. : 13/450386
DATED : November 10, 2015
INVENTOR(S) : Christopher Winnington-Ingram It is certified that error appears in the above-identified patent and that said Letters Patent is hereby corrected as shown below:

Title Page, Item (73) Assignee: Delete "SINGHIES" and insert --DINGHIES--

Signed and Sealed this
Eighth Day of March, 2016

Michelle K. Lee

Michelle K. Lee
*Director of the United States Patent and Trademark Office*